US005129874A

United States Patent [19]

Hayes, III et al.

[11] Patent Number: 5,129,874

[45] Date of Patent: Jul. 14, 1992

[54] BLANK LOCATING APPARATUS USING VIBRATION

[75] Inventors: Harold H. Hayes, III, Grove City; Jeffrey C. Reasinger, Columbus; Garold W. Alexander, Powell, all of Ohio

[73] Assignee: Pressware International, Inc., Columbus, Ohio

[21] Appl. No.: 628,412

[22] Filed: Dec. 17, 1990

[51] Int. Cl.[5] ..... B31B 1/02; B31B 3/44

[52] U.S. Cl. ..... 493/167; 493/417; 264/72; 264/320; 425/400; 414/754; 269/329

[58] Field of Search ..... 493/167, 417; 264/71, 264/72, 320; 425/400; 269/329; 414/754

[56] References Cited

U.S. PATENT DOCUMENTS

| | | | |
|---|---|---|---|
| 2,474,944 | 7/1949 | Henry | 493/417 |
| 3,881,605 | 5/1975 | Grossman | 414/754 |
| 4,425,075 | 1/1984 | Quinn | 414/755 |
| 4,436,479 | 3/1984 | Belloli | 414/757 |
| 4,778,439 | 10/1988 | Alexander | 425/400 |
| 4,781,566 | 11/1988 | Rossi et al. | 425/400 |
| 4,887,904 | 12/1989 | Nakazato et al. | 414/754 |
| 5,041,071 | 8/1991 | Reasinger et al. | 493/417 |

*Primary Examiner*—William E. Terrell
*Attorney, Agent, or Firm*—Frank H. Foster

[57] ABSTRACT

This invention relates to the field of paperboard tray forming machines which typically consist of an upper and lower die which interlock to deform a paperboard blank. The invention is an arcuate yoke having a pair of legs to which locating stops and side guide plates are rigidly attached. The die is angled to the earth so that a blank deposited onto the die is gravity biased toward the locating stops. The yoke is vibratingly driven and the blank is vibrated into position on the lower die by contacting the locating stops and side guide plates and vibrating to the blank's lowest position on the die.

7 Claims, 2 Drawing Sheets

BLANK LOCATING APPARATUS USING VIBRATION

TECHNICAL FIELD

This invention relates to the field of paperboard tray forming apparatus and more specifically to a method and a means for positioning paperboard blanks on dies prior to deformation.

BACKGROUND ART

Paperboard food trays are typically formed by compressing cut out paperboard blanks between two mating dies.

One problem with the process of compressing paperboard between two dies is that it is difficult to align the typically lightweight blank precisely in the desired location between the two dies. One result of misalignment may be the formation around the rim of the tray of flanges having non-uniform and unsightly variations in width. The conventional way of dealing with the difficulty in aligning blanks is to cut the flat paperboard into a blank which is larger than that which is needed to make the final product, deform the tray between the two dies, and introduce an additional step called post-trimming which includes trimming the outer edges of the deformed tray to the dimensions desired. This is not only an additional step but also introduces additional material, investment and labor expense due to the waste of paper and the additional machinery or manpower needed to perform this step.

The dies which are conventionally used consist of a lower die which is fixed in position (typically at an angle to horizontal so that the blanks can be gravity fed onto the die) and an upper die which is hydraulically or mechanically raised and lowered to mate with the lower die. The blank is fed onto the lower die and intended to slide down the surface of the die and come to rest against a series of guiding projections, the purpose of which is to guide and hold the blank in a desirable position prior to deformation. Sometimes, unfortunately, the blank may slide only part way down the die and get prematurely caught on one of the guiding projections or between them and stop in that position. At other times the blank may stop just short of one of the guiding projections instead of seating against it as intended. Then when the upper die compresses the blank, the outer edges of the formed tray are not equal all around the tray and post-trimming is necessary.

Therefore, there is a need for a blank positioning apparatus which eliminates the additional cost of post-trimming the deformed blank by accurately locating the blank at its desirable position prior to deformation.

BRIEF DISCLOSURE OF INVENTION

This invention is used in a paperboard tray forming machine which includes a lower die onto which a paperboard blank is deposited, and a pair of locating stops against which the blank is gravity biased. The invention is an improved blank positioning means comprising yoke movement relative to the lower die. The yoke has at least one pair of legs. The invention further comprises at least one blank locating stop rigidly attached to each leg and extending beside the blank on the lower die. The improved blank positioning means further comprises a vibrator driving the yoke to positively position the blank on and in registration with the lower die.

Figure 1:
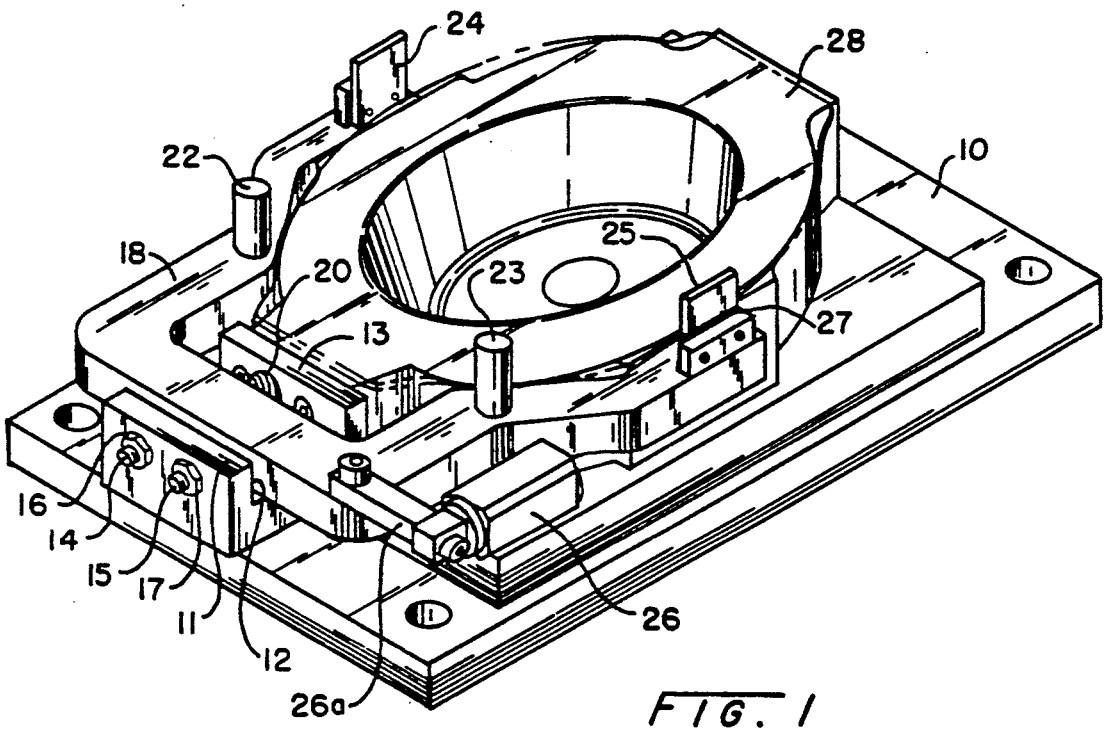
FIG. 1 is a view in perspective illustrating the preferred embodiment of the present invention.
Figure 2:
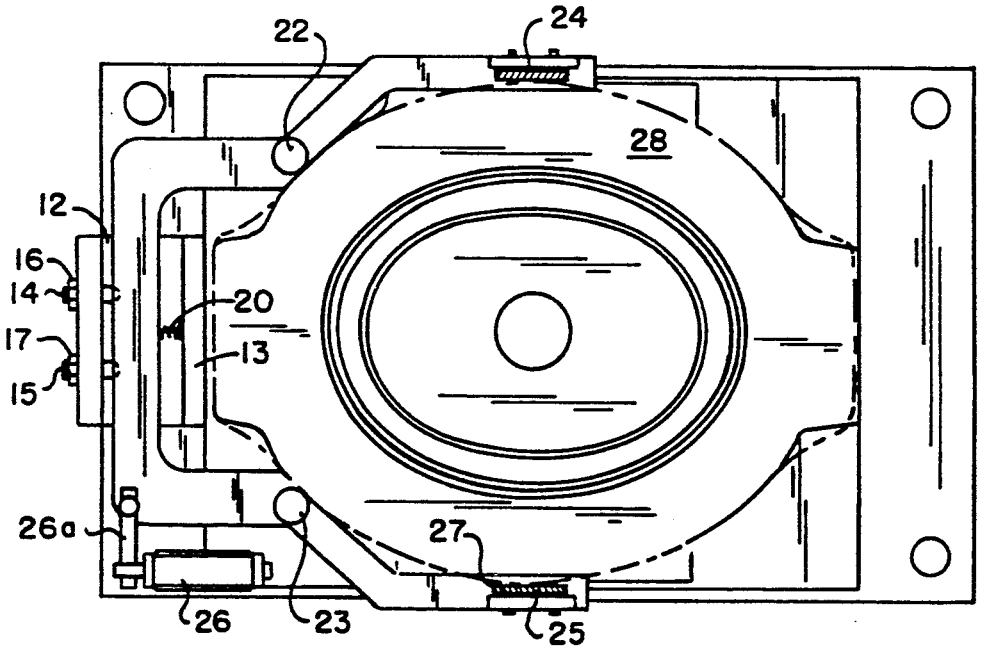
FIG. 2 is a top view illustrating an alternative embodiment.

In describing the preferred embodiment of the invention which is illustrated in the drawings, specific terminology will be resorted to for the sake of clarity. However, ti is not intended that the invention be limited to the specific terms so selected and it is to be understood that each specific term includes all technical equivalents which operate in a similar manner to accomplish a similar purpose.

DETAILED DESCRIPTION

FIG. 1 is a perspective view illustrating a lower die 10 with the preferred embodiment of the present invention in its preferred location. A retainer block 12 has two upwardly extending side walls 11 and 13 which are separated by a channel. The retainer block 12 is rigidly attached to the die 10. Two adjusting screws 14 and 15 are threaded through side wall 13 at opposite sides of and the same distance from the longitudinal axis of the die 10. The adjusting screws 14 and 15 have retaining nuts 16 and 17 threaded onto them which seat tightly against side wall 13 to prevent the adjusting screws 14 and 15 from vibrating loose or out of adjustment. The adjusting screws 14 and 15 extend out of the other side of side wall 13 into a channel region above the central portion of the retaining block 12 between side walls 11 and 13.

In this channel region generally the central portion of a yoke 18 is mounted. The retaining screws 14 and 15 have tapered tips which insert into matingly shaped countersunk holes in the edge of the yoke 18. On the edge of the yoke 18 opposite the adjusting screws 14 and 15 there is a coil spring 20 which is rigidly attached at one of its ends to the channel region edge of the side wall 15. The spring 20 is attached at its opposite end to the edge of the yoke 18. The spring 20 urges the yoke 18 into contact with, but not rigid attachment to the adjusting screws 14 and 15.

The yoke 18 has two legs which extend generally parallel to the plane of the die 10 on each side of the die 10. Blank locating stops 22 and 23 are rigidly attached to the yoke 18. One blank locating stop is attached on each leg located near the end of the yoke 18 where the yoke 18 mounts to the die 10. These blank locating stops 22 and 23 are generally cylindrical in the preferred embodiment and are attached to the yoke 18 with their outer circumferential surface located where the edge of the blank will rest against them when the blank is located in its ideal position on the die 10.

Two blank locating side guide plates 24 and 25 are also located on the yoke 18. One side guide plate is rigidly attached to each leg of the yoke 18 along generally the lateral axis of the die 10. The inner surfaces of the side guide plates 24 and 25 are located where the edge of the blank will contact them when the blank is located in its ideal position.

A vibrator 26, preferably of the type having a single oscillating piston driven by air, is mounted to an extension arm 26A which in turn is fastened to the yoke 18.

The vibrator 26 is drivingly linked through the arm 26A to drive the yoke 18 in vibratory motion. Of course, any suitable device which will cause the yoke 18 to vibrate could be substituted for the preferred air drive, single piston vibrator 26.

In an operable position, the die 10 is angled relative to the earth, causing a blank which is deposited at one end of the die 10 to be gravity biased toward the locating stops 22 and 23 and generally toward lower end of the die 10. A paperboard blank 28 is shown in phantom in FIG. 1 illustrating the ideal position of a blank on the die 10, positioned by the present invention. The blank locating stops 22 and 23 can be replaced with larger or smaller diameter or differently shaped stops to suit a particular shape or size of blank. Additionally, the side guide plates 24 and 25 may be replaced with plates of different shape or size to accommodate a particular blank. The side guide plates may also be moved outward of the die if a spaced is placed in a "stair step" 27 on the yoke 18.

The preferred embodiment illustrated in FIG. 1 operates as follows. The die 10 is angled relative to the horizontal at an angle of approximately 45° and a paperboard blank 28 is fed onto the higher end of the die 10 in a conventional manner known in the art. During the feeding of the blank 28 onto the die 10, the vibrator 26 vibrates the yoke 18, which causes the blank locating stops 22 and 23 and the side guide plates 24 and 25 to vibrate. As the blank 28 slides along the die 10, it contacts the blank locating stops 22 and 23 and the side guide plates 24 and 25. Because these parts are vibrating, any edge of the blank 28 which comes into contact with one or more of them is batted away a small distance which reduces friction and causes it to slide more quickly to its lowest position on the die 10. The lowest position on the die 10 is the point where the edges of the blank 28 seat against the blank locating stops 22 and 23 and side guide plates 24 and 25 and the center of gravity of the blank 28 is preferably located centrally between the blank locating stops 22 and 23.

After the blank 28 has seated symmetrically against the blank locating stops 22 and 23 and the side guide plates 24 and 25, the blank 28 vibrates with the yoke 18 at its generally high frequency and very low amplitude. After this series of events occurs, the feeding of the blank 28, the vibration of the blank 28 toward its lowest energy point, and the arrival of the blank 28 at the lowest position on the die, the upper die is then forced downward onto the lower die 10 and the blank 28 is deformed.

As the yoke 18 in the preferred embodiment vibrates, the blank locating stops 22 and 23 vibrate with components of motion both longitudinally and laterally relative to the die. This is due to the fact that the yoke 18 has two locations which can alternate as pivot points to create a rocking motion. As the yoke 18 vibrates from side to side, for example, from the bottom of the page in FIG. 1 to the top of the page, the yoke 18 first rocks on the end of the adjusting screw 15, which is the initial pivot point of the yoke 18. When the yoke 18 pivots far enough that the adjusting screw 14 contacts the other countersunk surface in the yoke 18, the pivot point changes to the end of the adjusting screw 14. Since the blank locating stops 22 and 23 and the side guide plates 24 and 25 are located at some distance from the pivot points at the ends of the adjusting screws 14 and 15, there are components of motion along both axes of the die, regardless of which direction the vibrator 26 drives the yoke 18 due to their arcuate motion when pivoting around the pivot points. The longitudinal location of the two pivot points at the ends of the adjusting screws 14 and 15 may be changed by merely further protruding or withdrawing one or both of the adjusting screws 14 and 15.

The present invention induces vibratory motion in a blank to keep the blank in motion so that, as the blank interfaces with the die 10, the only friction which the blank encounters is kinetic friction. As a basic instructional mode, it is well known that if a body lies on another body, the top body can move relative to the bottom body if the force of static friction between them is overcome. However, if the top body is already moving relative to the bottom body, then the force of kinetic friction between the two bodies must be overcome to keep the body in motion. The force of static friction is always greater than the force of kinetic friction. Therefore, in the structure at hand if the blank is kept in motion by vibration, for example, and only experiences a resistance force of kinetic friction, then a lower force must be overcome by the gravity fed blank to get the blank to reach its lowest position on the die 10. This increases the speed and the likelihood of the blank coming into registration with the die. Previous devices allowed the blank to stop its motion before it reached its ideal position on the die 10. The present invention forces the blank to stay in motion at least until it reaches the bottom of the die 10.

It is an object of the present invention to vibrate the blank on the die to cause it to more quickly and accurately reach the lowest portion on the die (between vibrating guides and stops) which has been designed into the machine to be the position at which deformation of the blank will result in an ideally formed tray.

Figure 3:
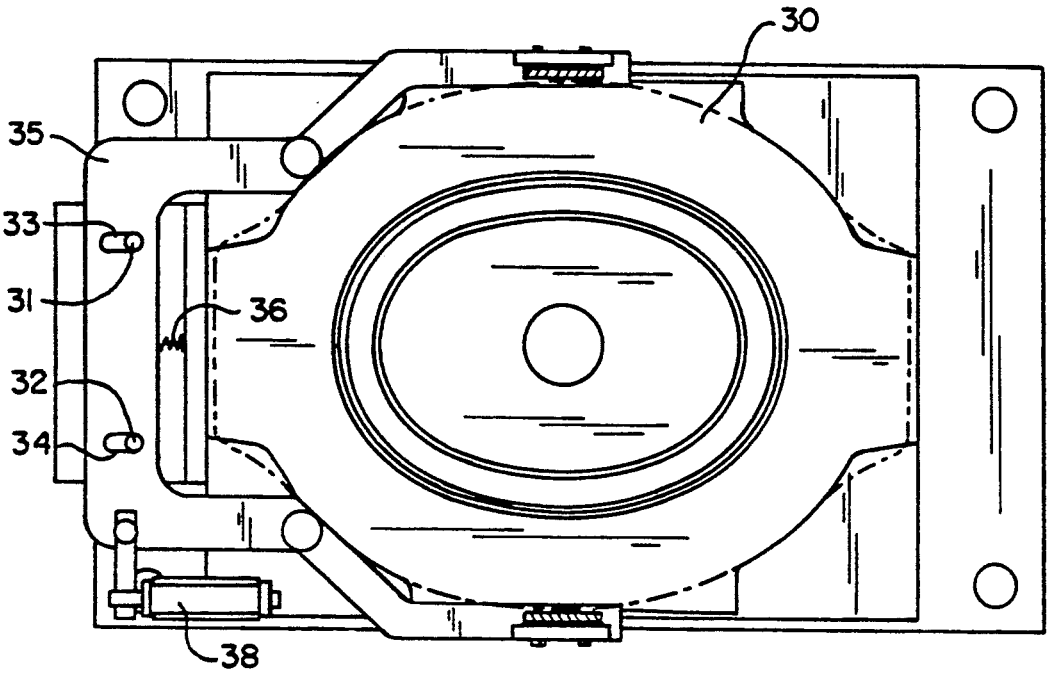
FIG. 3 is a top view illustrating an alternative embodiment.

FIG. 3 illustrates an alternative embodiment of the present invention in which a die 30 has two rods 31 and 32 extending upwardly from the die 30 at one end, each rod 31 and 32 extending through a different one of two elliptical holes 33 and 34 formed in a yoke 35. A spring 36 is rigidly attached at one of its ends to the die 30 and is attached at its opposite end to an edge the yoke 35, forcing the yoke 35 away from the forming region of the die 30 and forcing the edges of the elliptical holes 33 and 34 against rods 31 and 32. A vibrator 38 is attached rigidly to the die 30 and is drivingly linked to the yoke 35. The vibrating yoke 35 rocks on the rods 31 and 32, back and forth against the bias of the spring 36, just as the preferred yoke 18 rocks against the adjusting screws 14 and 15 in FIG. 1.

Figure 4:
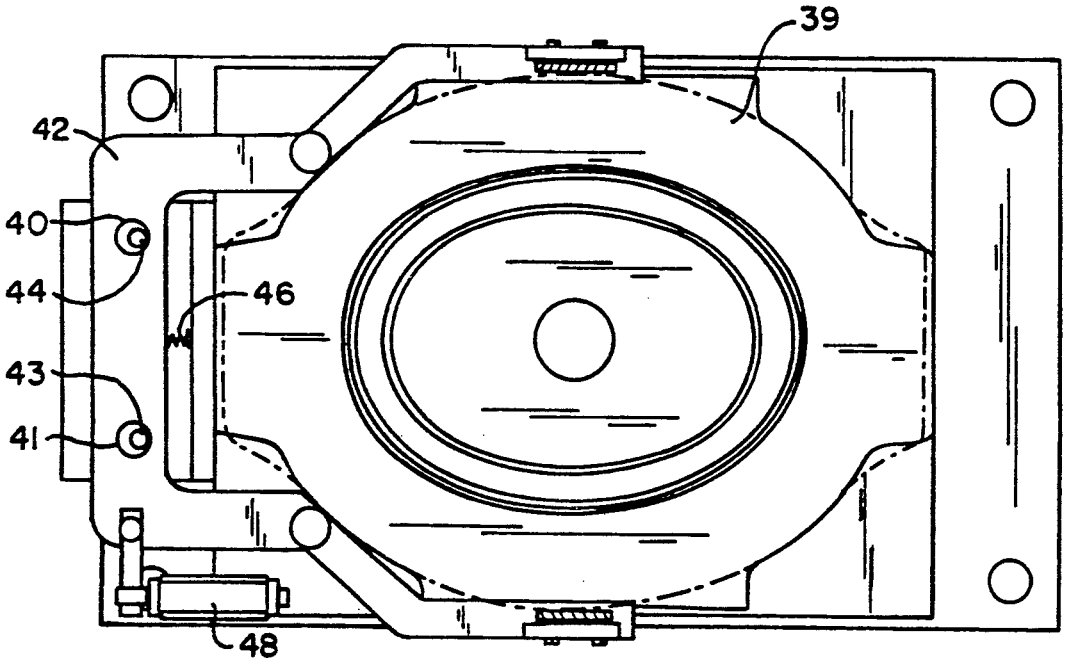
FIG. 4 is a top view illustrating yet another alternative embodiment.

FIG. 4 is an identical embodiment to FIG. 3 except that it has round holes 40 and 41, formed through a yoke 42, which have a diameter greater than that of two rods 43 and 44. The rods 43 and 44 extend upwardly from rigid attachment to a die 39, through the holes 40 and 41. A spring 46 forces the yoke 42 against the rods 43 and 44. The embodiment of FIG. 4 has the advantage of being self-centering since the rods 43 and 44 will automatically seek the farthest extreme edge of the holes 40 and 41 formed in the yoke 42 as the spring 46 biases the yoke 42 against the rods 43 and 44. Just as before, a vibrator 48, vibrates the yoke 42 as it rocks against the rods 43 and 44.

The preferred vibrator is a Cleveland Vibrator Company model VM-25 which is driven by approximately 25 to 27 PSI of air pressure resulting in a frequency and amplitude of vibration which cause blanks deposited on the dies to register with the die quickly. At 20 PSI the blank does not register quickly enough with the die and at 30 PSI the blank bounces around erratically on the die, thereby not registering with the die. The amplitude and frequency of vibration of the preferred vibrator are determined by the amount of air pressure used to drive the vibrator. The amplitude and frequency of the vibrator may be changed for a blank of different size, shape or weight.

While certain preferred embodiments of the present invention have been disclosed in detail, it is to be understood that various modifications may be adopted without departing from the spirit of the invention or scope of the following claims.

We claim:

1. In a paperboard tray forming machine, including a lower die onto which a paperboard blank is fed, an upper die spaced from ad moveable into engagement with the lower die and a pair of locating stops against which the blank is gravity biased, an improved blank positioning apparatus comprising:

(a) a yoke, having at least one pair of legs extending to the laterally opposite side of the lower die, the yoke being movably mounted to the lower die allowing yoke movement relative to the lower die in the plane of a blank on the die;

(b) at least one blank locating stop rigidly attached to each leg of the yoke and extending beside the blank on the lower die; and (c) a vibrator drivingly connected to the yoke for vibrating the stops to prevent the blank from becoming prematurely caught in misalignment upon the lower die and to permit the blank to descend on and in registration with the lower die.

2. The blank positioning apparatus in accordance with claim 1 wherein the yoke is mounted to the lower die by an apparatus comprising a bias means between the yoke and the lower die for biasing the yoke to an average, centered position.

3. The blank positioning apparatus in accordance with claim 2 wherein the yoke mounting apparatus further comprises:

(a) a spring attached at one end to the lower die and attached at the opposite end to the yoke; and (b) at least one adjusting screw attached to the lower die and seated against the yoke on the opposite side of the bias means.

4. The blank positioning apparatus in accordance with claim 2 or 3 wherein the yoke mounting apparatus further comprises at least one elongated slot formed in the yoke through which a rod, which is rigidly attached to the die, extends.

5. The blank positioning apparatus in accordance with claim 2 or 3 wherein the yoke mounting apparatus further comprises at least one hole formed in the yoke through which a rod, which is rigidly attached to the die, extends and in which the inner diameter of the hole through the yoke is greater than the outer diameter of the rod.

6. The blank positioning apparatus in accordance with claim 1 wherein at least one blank locating side guide plate is also rigidly attached to said yoke, spaced from the stops and also extending beside the blank on the lower die.

7. In a paperboard tray forming machine including a lower die onto which a paperboard blank is fed, an upper die spaced from and movable into engagement with the lower die and a pair of blank locating stops against which the blank is gravity biased, an improved blank positioning method comprising vibrating at least one pair of blank stops which extend laterally beside the blank on the lower die for preventing the blank from becoming prematurely caught in misalignment upon the lower die and to permit the blank to descend on and in registration with the lower die.

* * * * *